US005752130A

United States Patent [19]

Tanaka et al.

[11] Patent Number: 5,752,130

[45] Date of Patent: May 12, 1998

[54] IMAGE FORMING APPARATUS FOR CLEANING RESIDUAL TONER FROM AN INTERMEDIATE TRANSFER MEMBER

[75] Inventors: Atsushi Tanaka, Yokohama; Hiroyuki Kobayashi, Fuji; Akihiko Nakazawa, Shiroyamamachi; Tsunenori Ashibe, Yokohama; Takashi Kusaba, Kodaira, all of Japan

[73] Assignee: Canon Kabushiki Kaisha, Tokyo, Japan

[21] Appl. No.: 674,836

[22] Filed: Jul. 3, 1996

[30] Foreign Application Priority Data

Jul. 7, 1995 [JP] Japan ..... 7-172307

[51] Int. Cl.[6] ..... G03G 15/16

[52] U.S. Cl. ..... 399/101; 399/99; 399/100; 399/123; 399/129; 399/308; 399/349; 399/353; 399/354; 430/125; 430/126

[58] Field of Search ..... 430/125, 126; 399/129, 99, 101, 100, 123, 349, 353, 354

[56] References Cited

U.S. PATENT DOCUMENTS 4,903,081 2/1990 Takahashi ..... 399/101
5,115,281 5/1992 Ohtsuka et al. .

FOREIGN PATENT DOCUMENTS 56-153357 11/1981 Japan .
63-301960 12/1988 Japan .
1-105980 4/1989 Japan .
4-340564 11/1992 Japan .
5-297739 11/1993 Japan .
5-303310 11/1993 Japan .

*Primary Examiner*—George F. Lesmes
*Assistant Examiner*—Cheryl Juska
*Attorney, Agent, or Firm*—Fitzpatrick, Cella, Harper & Scinto

[57] ABSTRACT

An image forming apparatus includes a first image-bearing member, latent image-forming unit for forming an electrostatic latent image on the first image-bearing member, developer for developing the electrostatic latent image with a toner to form a toner image, an intermediate transfer member for receiving the toner image by primary transfer and transferring the toner image onto a second image-bearing member by secondary transfer, a charging member for charging a residual toner remaining on the intermediate transfer member after the secondary transfer, and a recovery member for recovering the charged residual toner at a recovery position by voltage application. The intermediate transfer member exhibits a charging characteristic such that it has a surface potential of at most 500 volts as an absolute value at the recovery position. The intermediate transfer member having such a charging characteristic is effective in suppressing an occurrence of electric discharge at the recovery position of the residual toner to provide an excellent cleaning performance.

13 Claims, 4 Drawing Sheets

IMAGE FORMING APPARATUS FOR CLEANING RESIDUAL TONER FROM AN INTERMEDIATE TRANSFER MEMBER

FIELD OF THE INVENTION AND RELATED ART

The present invention relates to an image forming apparatus, particularly an image forming apparatus, such as a copying machine, a printer and a facsimile apparatus, of a type wherein a toner image formed on a first image-bearing member is once transferred to an intermediate transfer member (primary transfer), and then further transferred to a second image-bearing member (secondary transfer). The present invention further relates to an image forming method using such an image forming apparatus.

An image forming apparatus using an intermediate transfer member is more advantageous than an image forming apparatus wherein toner images are transferred from a first image-bearing member onto a second image-bearing member attached onto or attracted by a transfer drum (e.g., as disclosed in Japanese Laid-Open Patent Application (JP-A) 63-301960) in the respects (1) and (2) shown below since no means is required for processing or controlling the second image-bearing member (e.g., gripping by a gripper, attracting, providing a curvature, etc.).

(1) Little color deviation occurs during superposition of respective color images.

(2) A wide variety of second image-bearing member can be used. For example, it is possible to use from a thin paper of ca. 40 g/m$^2$ to a thick paper of ca. 200 g/m$^2$ equally as a second image-bearing member. Further, the transfer can be performed regardless of a difference in width and/or length of the second image-bearing member, so that it is applicable to even an envelope, a post-card or a label paper.

Such an image forming apparatus is required to remove a residual toner remaining on the intermediate transfer member after secondary transfer (transfer from the intermediate transfer member to the second image-bearing member).

In order to comply with such a requirement, an image forming apparatus of a type wherein a residual toner remaining on an intermediate transfer member is scraped by abutting or pressing an elastic blade against the intermediate transfer member has been disclosed in, e.g., JP-A 56-153357 or JP-A 5-303310.

Further, a method wherein a residual toner remaining on an intermediate transfer member is supplied with an electric field of a polarity identical or opposite to that of the residual toner to be returned to a photosensitive member has been disclosed in, e.g., JP-A 4-340564 or JP-A 5-297739.

JP-A 1-105980 has disclosed a method wherein a residual toner remaining on an intermediate transfer member is charged to have a surface potential of a polarity opposite to that of a photosensitive member After primary transfer, thereby to return the residual toner to the photosensitive member.

However, the above-described image forming apparatus and methods have encountered the following problems, respectively.

The image forming apparatus as described in JP-A 56-153357 or JP-A 5-303310 wherein cleaning is performed by using only mechanical force may be a problem because the residual toner is liable to slip or pass through the elastic blade, thus being liable to result in cleaning failure.

According to the method a disclosed in JP-A 4-340564 or JP-A 5-297739, the residual toner can include a component having a polarity opposite to that of a predominant component, so that the residual toner is not satisfactorily recovered in some cases.

Further, the residual toner as in JP-A 1-105980 is recovered by only a Coulomb force exerted by an electric charge of the charged photosensitive member by primary transfer on the residual toner, so that the residual toner is not satisfactorily recovered in some cases.

SUMMARY OF THE INVENTION

Accordingly, a principle object of the present invention is to provide an image forming apparatus including an intermediate transfer member capable of exhibiting a good cleaning performance in repetitive use, and also an image forming method using such an image forming apparatus.

According to the present invention, there is provided an image forming apparatus, comprising:

a first image-bearing member, latent image-forming means for forming an electrostatic latent image on the first image-bearing member, developing means for developing the electrostatic latent image with a toner to form a toner image, an intermediate transfer member for receiving the toner image by primary transfer and transferring the toner image onto a second image-bearing member by secondary transfer, a charging member for charging a residual toner remaining on the intermediate transfer member after the secondary transfer, and a recovery member for recovering the charged residual toner at a recovery position by voltage application, wherein the intermediate transfer member has a charging characteristic such that it has a surface potential of at most 500 volts as an absolute value at the recovery position.

According to another aspect of the present invention, there is provided an image forming method, comprising the steps of:

forming an electrostatic latent image on a first image-bearing member, developing the electrostatic latent image with a toner to form a toner image, primary-transferring the toner image onto an intermediate transfer member, secondary-transferring the primary-transferred toner image onto a second image-bearing member, charging a residual toner remaining on the intermediate transfer member after the secondary transfer, recovering the charged residual toner at a recovery position by voltage application, and using the intermediate transfer member having a charging characteristic such that it has a surface potential of at most 500 volts as an absolute value at the recovery position.

These and other objects, features and advantages of the present invention will become more apparent upon a consideration of the following description of the preferred embodiments of the present invention taken in conjunction with the accompanying drawings.

DETAILED DESCRIPTION OF THE INVENTION

In an image forming apparatus including a first image-bearing member, latent image-forming means for forming an electrostatic latent image on the first image-bearing member, developing means for developing the electrostatic latent image with a toner to form a toner image, and an intermediate transfer member for receiving the toner image by primary transfer and transferring the toner image onto a second image-bearing member by secondary transfer; the image forming apparatus according to the present invention is characterized by a charging member for charging a residual toner remaining on the intermediate transfer member after the secondary transfer, a recovery member for recovering the charged residual toner at a recovery position by voltage application, and the intermediate transfer member exhibiting a charging characteristic such that it has a surface potential of at most 500 volts as an absolute value at the recovery position.

The image forming method according to the present invention comprising the steps of: forming an electrostatic latent image on a first image-bearing member, developing the electrostatic latent image with a toner to form a toner image primary-transferring the toner image onto an intermediate transfer member, secondary-transferring the primary-transferred toner image onto a second image-bearing member is characterized by a specific cleaning step including: charging a residual toner remaining on the intermediate transfer member after the secondary transfer, and recovering the charged residual toner at a recovery position by voltage application while using the intermediate transfer member having a charging characteristic such that it has a surface potential of at most a 500 volts as an absolute value at the recovery position.

Hereinbelow, the image forming apparatus according to the present invention will be explained.

Figure 1:
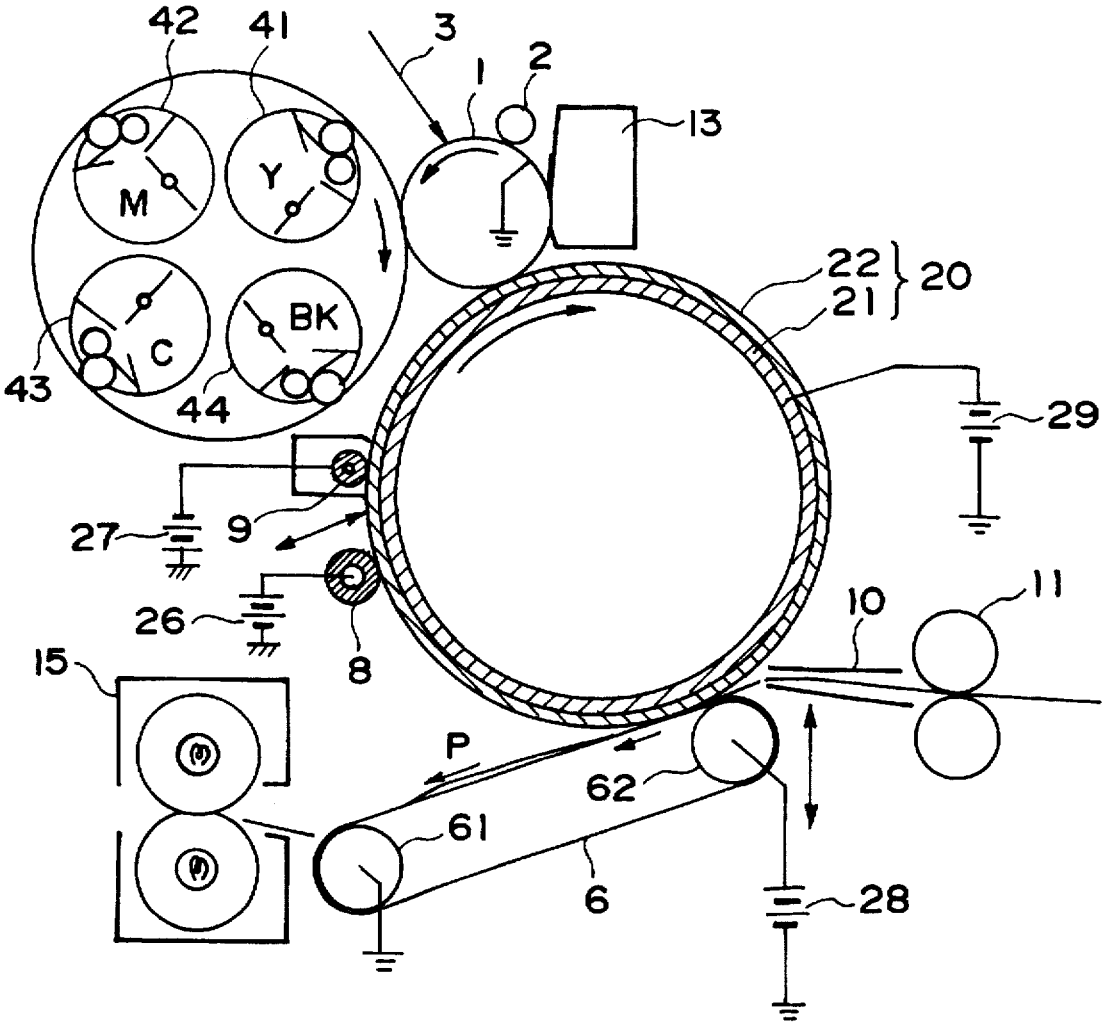
FIG. 1 is an illustration of an image forming apparatus of the present invention including an intermediate transfer member in the form of a drum.

FIG. 1 shows an outline of an example of image forming apparatus using a drum-shaped intermediate transfer member according to the present invention.

The image forming apparatus shown in FIG. 1 includes a drum-type electrophotographic photosensitive member (hereinafter simply called "photosensitive drum") as a first image-bearing member, which is driven in rotation in an arrow direction at a prescribed peripheral speed (process speed).

During the rotation, the photosensitive drum 1 is uniformly charged to a prescribed potential of a prescribed polarity by a primary charger 2 and then receives (imagewise) exposure light 3 from an imagewise exposure means (not shown). As a result, an electrostatic latent image corresponding to a first color component image (e.g., yellow component image) to an objective color image is formed on the photosensitive drum 1.

Then, the electrostatic latent image is developed into a yellow component image (as a first color component image) by a first developing device 41 (yellow developing device). At this time, second to fourth developing devices, i.e., a magenta developing device 42, a cyan developing device 43 and a black developing device 44, are not operated, thus not acting on the photosensitive drum 1, so that the first color yellow component image is not affected by the second to fourth developing devices 42–44

An intermediate transfer member 20 includes a cylindrical support member 21 and an elastic layer 22 formed around the outer periphery thereof, and driven in rotation in an indicated arrow direction at a peripheral speed identical to that of the photosensitive drum 1.

The first color yellow component image formed on the photosensitive drum 1 is sequentially primary-transferred to the outer periphery of the intermediate transfer member 20 while it passes through a nip between the photosensitive drum 1 and the intermediate transfer member 20 under the action of an electric field formed by a primary transfer bias (voltage) applied to the intermediate transfer member 20.

A residual toner remaining on the surface of the photosensitive drum 1 after transfer (primary transfer) of the first color yellow toner image is cleaned by a cleaning device 13.

Thereafter, in similar manners, a second color magenta component image, a third color cyan component image and a fourth color black component image are sequentially transferred in superposition onto the intermediate transfer member 20 to form an objective full color image thereon.

The transfer bias for sequentially transferring the (first to fourth color) toner images from the photosensitive drum 1 in superposition onto the intermediate transfer member 20 is of a polarity opposite to that of the toner and is applied from a bias supply 29.

The image forming apparatus further includes a transfer belt 6, which is supported on a shaft in parallel with the intermediate transfer member 20 so as to contact the lower surface thereof. However, the transfer belt 6 is disposed in separation from the intermediate transfer member 20 during the primary transfer step. The transfer belt 6 is supported by a transfer roller 62 and a tension roller 61. The transfer roller 62 is supplied with a prescribed secondary transfer bias from a bias supply 28, and the tension roller 61 is grounded.

The full-color toner image superposedly transferred onto the intermediate transfer member 20 is secondary-transferred to a transfer(-receiving) material (second image-bearing member) P by causing the transfer belt 6 to abut against the intermediate transfer member 20, supplying the transfer material P from a paper supply cassette (not shown) to the abutting position between the intermediate transfer member 20 and the transfer belt 6 via a transfer material-supplying roller 11 and a transfer material guide 10 at prescribed time and simultaneously by applying a secondary transfer bias from the bias supply 28 to the transfer roller 62. The transfer material P bearing the transferred toner image is then introduced to a fixing device 15 for hot fixing of the toner image.

After the completion of the image transfer onto the transfer material P, a transfer residual toner on the intermediate transfer member 20 is cleaned. The cleaning step of the residual toner remaining on the intermediate transfer member 20 without being transferred to the transfer material P at the time of the secondary transfer will be described below with reference to FIG. 2 showing a cleaning section of the intermediate transfer member 20 in combination with FIG. 1.

Figure 2:
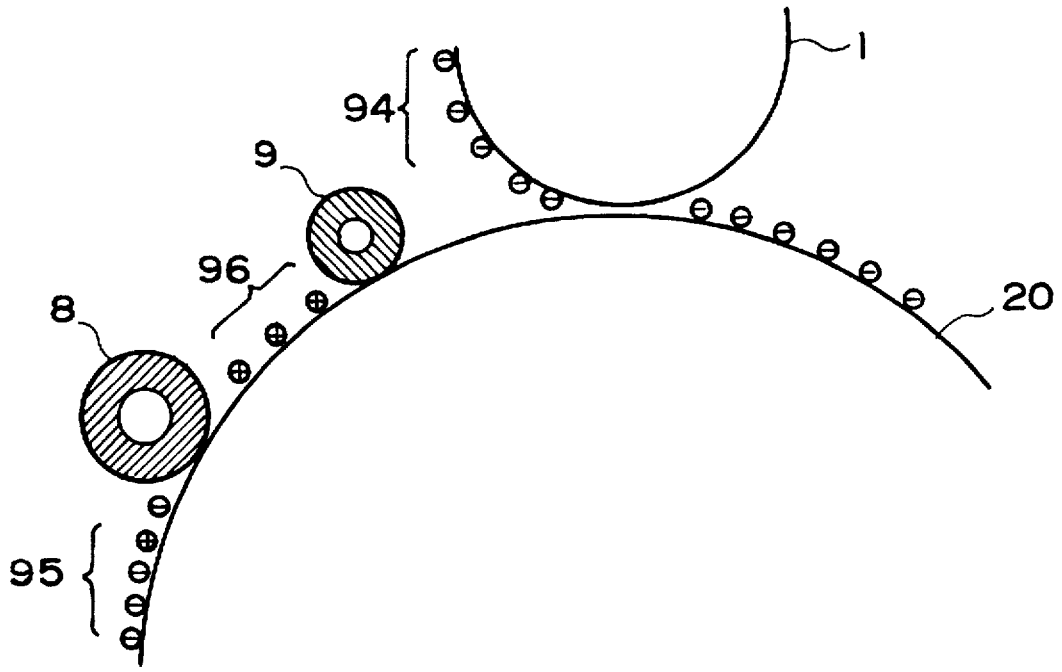
FIG. 2 is a partially enlarged view for illustrating a mechanism of cleaning of a residual toner.

Referring to FIGS. 1 and 2, a charging member 8 for charging and cleaning the transfer residual toner on the intermediate transfer member 20 (hereinbelow, sometimes referred to as "cleaning charging member") and a recovery member 9 for recovering the transfer residual toner charged by the (cleaning) charging member 8 are respectively disposed opposite to the intermediate transfer member 20 and are supplied with a voltage of a prescribed polarity from power supplies 26 and 27, respectively.

As described above, most of the toner providing the toner image is secondary-transferred to the transfer material P but a small amount of the toner is not (secondary-)transferred to the transfer material P to remain on the intermediate transfer member. Such a transfer residual toner 95 as shown in FIG. 2 has various electric charges. For this reason, the electric charges of the transfer residual toner 95 are uniformized by applying a voltage of a polarity (positive in this case) from the power supply 26 to the charging member 8. A residual toner 96 having a uniform charge is recovered at a recovery position (where the residual toner is recovered) by the recovery member 9 supplied with a voltage of a polarity (negative in this case) opposite to that of the residual toner 95 from the power supply 27 to provide the intermediate transfer member 20 with a cleaned surface.

In the present invention, the intermediate transfer member 20 may preferably exhibit a charging characteristic so as to have a surface potential of at most 500 volts (V) as an absolute value, preferably at most 300 (V), at the recovery position. If the surface potential exceeds 500 V (as absolute value), cleaning failure occurs. This is presumably because discharge between the intermediate transfer member 20 and the recovery member 9 is caused to occur, thus disordering the electric charge of the transfer residual toner charged by the charging member 8.

Further, the above surface potential may preferably be at least 2 (V) (as absolute value). Below 2 (V), the transfer residual toner is not readily charged sufficiently.

In the present invention, the charging characteristic of the intermediate transfer member is provided as a surface potential (as absolute value) at the recovery position, not the charging position by the cleaning charging roller. This is because the surface potential (as absolute value) is lowered with time after the charging due to a dark decay characteristic of electric charge at the surface of the intermediate transfer member.

The surface potential of the intermediate transfer member 20 may be measured, e.g., in the following manner.

Figure 3:
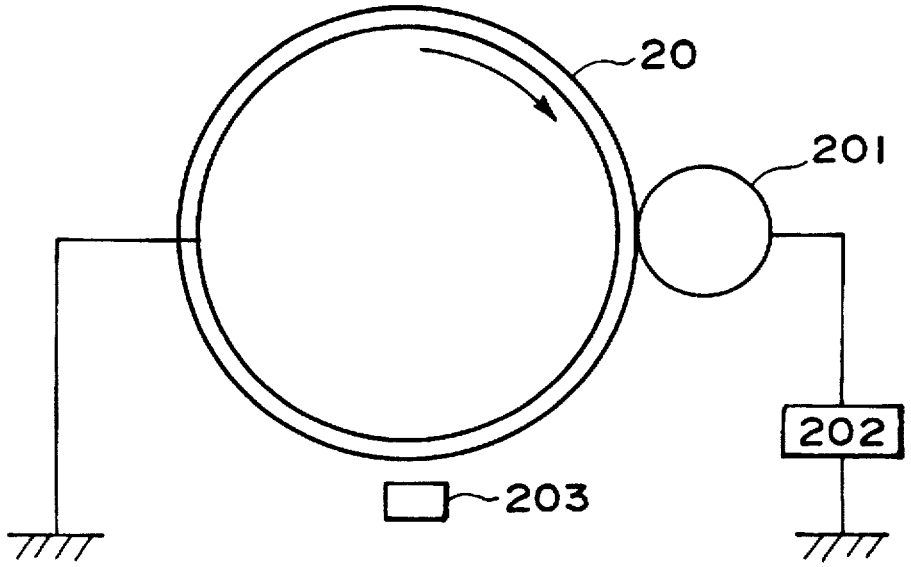
FIG. 3 is an electrical circuit diagram for measuring a surface potential of an intermediate transfer member.

FIG. 3 shows an electric circuit diagram for measurement of the surface potential.

Referring to FIG. 3, an intermediate transfer member 20 and a metal roller 201 connected to a DC (direct current) power supply 202 are caused to abut against each other at a linear pressure of 30 g/cm so that their shafts are in parallel with each other. The metal roller 201 is driven in rotation and controlled so as to provide the (mating) intermediate transfer member 20 with a prescribed peripheral speed (process speed) (120 mm/sec in this instance) identical to that of an intermediate transfer member when actually used in an image forming apparatus. At a position downstream from the abutting portion of the metal roller 201, a surface potential meter (surface electrometer) 203 ("MODEL 344A", mfd. by Trek Co.) is disposed so that a distance from the metal roller 201 to the surface potential meter 203 is set to be equal to a distance from a cleaning charging member to the recovery position of the transfer residual toner used in an image forming apparatus including the intermediate transfer member.

To the above electric circuit, a voltage (constant voltage) of +2.5 (kV) is applied from the DC power supply 202. At this time, a surface potential of the intermediate transfer member 20 (at the recovery position of the residual toner) is measured by the surface potential meter 203 under an environmental condition of 23° C. and 40% RH.

The intermediate transfer member used in the present invention includes a support and at least one layer disposed on the support comprising materials, such as rubbers, elastomers and resins. The layer includes an elastic layer and at least one coating layer.

The elastic layer may preferably have an appropriate degree of elasticity, e.g., a JIS A rubber hardness (JIS K6301) of 20–80 deg., so as to allow the intermediate transfer member to contact the first and second image-bearing members.

The coating layer is a layer for coating the elastic layer and does not necessarily have elasticity. In case where the coating layer constitutes a surface layer, the coating layer is required to have at least releasability. In the case of the coating layer disposed between the elastic layer and another layer (e.g., surface layer), the coating layer is required to have at least adhesiveness to these layers.

Figure 5:
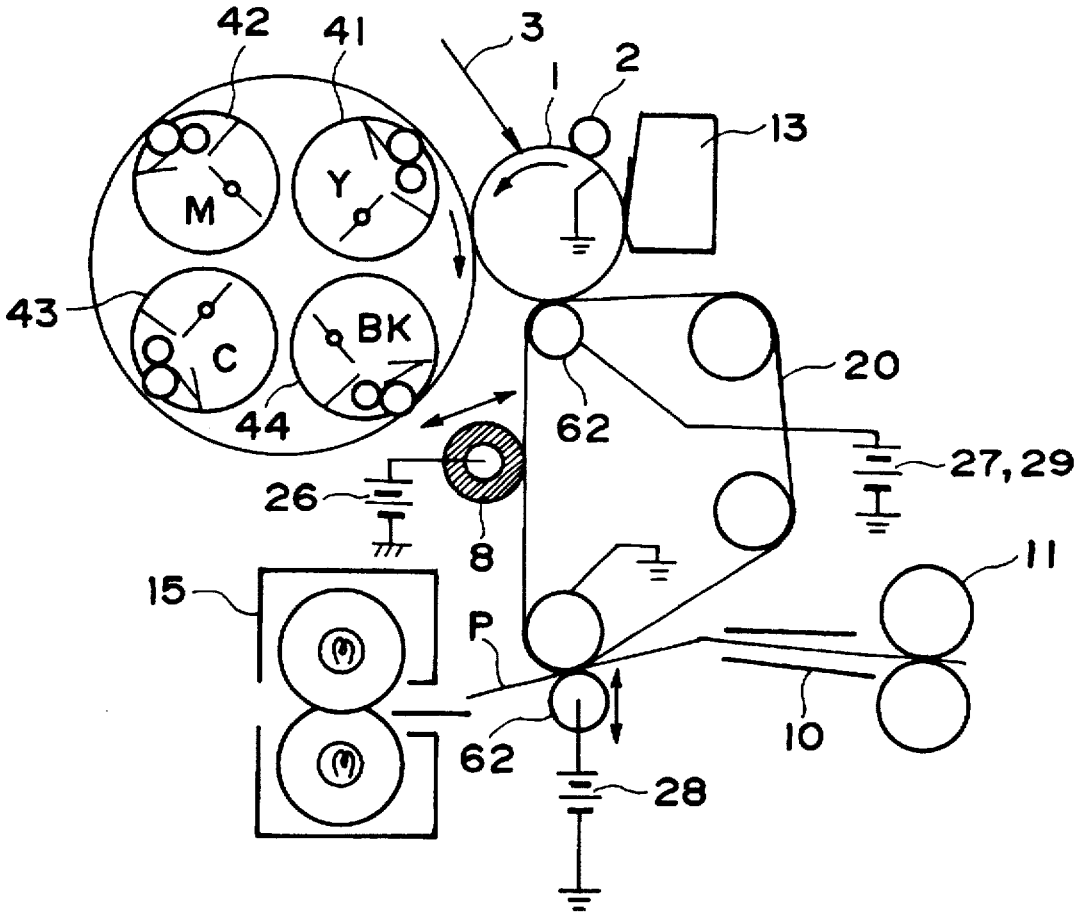
FIG. 5 is an illustration of an image forming apparatus of the present invention including an intermediate transfer member in the form of an endless belt.

The intermediate transfer member may assume various forms inclusive of a drum 20 as shown in FIG. 1 and an endless belt 20 as shown in FIG. 5 wherein other members are similar to those in FIG. 1 and indicated by identical reference numerals as in FIG. 1.

Figure 6:
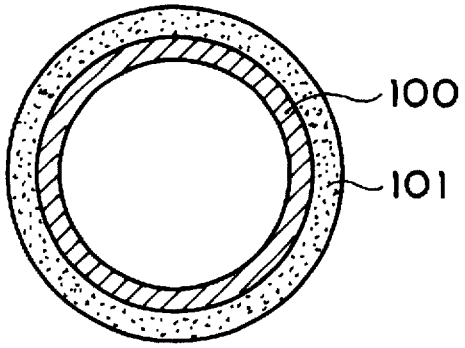
FIG. 6 is an illustration of a drum-shaped intermediate transfer member having an elastic layer.
Figure 7:
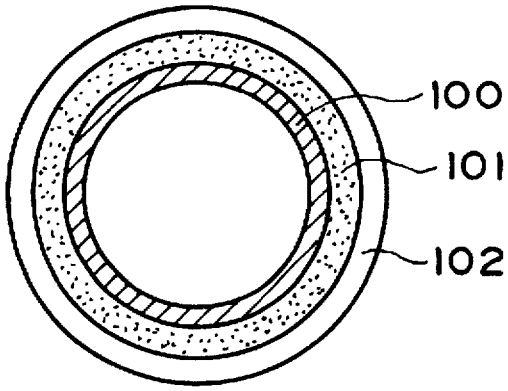
FIGS. 7 and 8 are illustrations of drum-shaped intermediate transfer members having a coating layer and plural coating layers, respectively, on an elastic layer.
Figure 8:
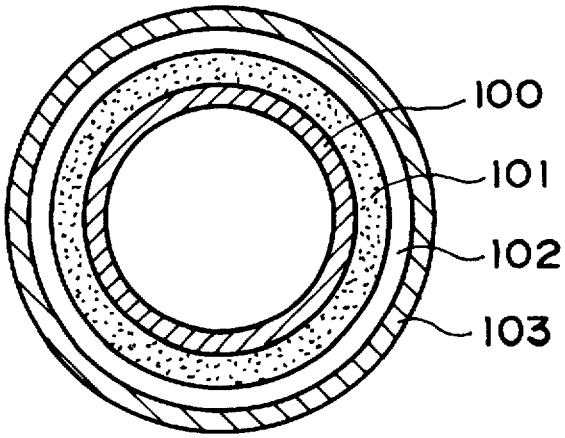

Specific examples of the drum-shaped intermediate transfer member are shown in FIGS. 6–8 wherein a drum-shaped intermediate transfer member is constituted by disposing an elastic layer 101 on a support 100 (FIG. 6); disposing an elastic layer 101 and a coating layer 102 in this order on a support 100 (FIG. 7); or disposing an elastic layer 101, a coating layer 102 and a coating layer 103 in this order on a support 100 (FIG. 8).

In the present invention, it is preferred to use a drum- (or roller-)shaped intermediate transfer member in view of little color deviation during superposition of images and durability in repetitive use. On the other hand, an intermediate transfer member in the form of an endless belt is advantageous in providing a smaller size of image forming apparatus.

The support (e.g., 21 in FIG. 1 or 10 in FIGS. 6–8) may preferably comprise a metal or alloy, such as aluminum, iron, copper or stainless steel, or an electroconductive resin containing electroconductive carbon or metal particles. The support may have a shape of a drum or an endless belt as described above, inclusive of a drum equipped with a shaft piercing therethrough and a cylindrical bar (a drum the inside of which is reinforced).

Examples of a rubber or elastomer and a resin constituting the elastic layer and/or the coating layer may include: elastomers or rubbers, such as natural rubber, isoprene rubber, styrene-butadiene rubber, butadiene rubber, butyl rubber, ethylene propylene rubber, ethylene-propylene terpolymer, chloroprene rubber, chlorosulfonated polyethylene, chlorinated polyethylene, acrylonitrile-butadiene rubber, urethane rubber, syndiotactic 1,2-polybutadiene, epichlorohydrin rubber, acrylic rubber, silicone rubber, fluoro rubber polysulfide rubber, norborene rubber, hydrogenated nitrile rubber, and theroplastic elastomers (e.g., of polystyrene-type, polyolefin-type, polyvinyl chloride-type, polyurethane-type, polyamide-type, polyester-type and fluorine-containing resin-type); and resins, such as styrene-based resins (homopolymers and copolymers of styrene and substituted styrene, inclusive of polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymers (such as styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymers (such as styrene-methyl methacrylate copolymer, styrene-ethyl methacrylate copolymer and styrene-phenyl methacrylate copolymer), styrene-methyl α-chloroacrylate copolymer, and styrene-acrylonitrile-acrylate copolymers; methyl methacrylate resin, butyl methacrylate resin, ethyl acrylate resin, butyl acrylate resin, modified acrylic resins (such as silicone-modified acrylic resin, vinyl chloride-modified acrylic resin, and acrylic-urethane resin), vinyl chloride resin, styrene-vinyl acetate copolymer, vinyl chloride-vinyl acetate copolymer, rosin-modified maleic acid resin, phenolic resin, epoxy resin, polyester resin, polyester-polyurethane resin, polyethylene, polypropylene, polybutadiene, polyvinylidene chloride, ionomer resins, polyurethane resin, silicone resin, ketone resin, ethylene-ethyl acrylate copolymer, xylene resin, polyvinyl butyral resin, polyamide resin, and modified polyphenylene oxide resin. These rubbers or elastomers, and resins can also be used in combination of two or more species.

The elastic layer and the coating layer(s) may contain an electroconductive material.

Preferred but non-limitative examples of the electroconductive material used in the present invention may comprise carbon, aluminum powder, nickel powder, and electroconductive resins.

Examples of the electroconductive resin may include: polymethyl methacrylate containing a quaternary ammonium salt, polyvinylaniline, polyvinylpyrrole, polydiacetylene, boron-containing polymers and polyethyleneimine.

The surface layer (elastic or coating layer) of the intermediate transfer layer used in the invention may preferably containing powders of high-lubricative resins, such as tetrafluoroethylene resin.

The elastic layer may preferably have a thickness of 0.5–10 mm, more preferably 1–5 mm. On the other hand, the coating layer may preferably be thin so as to conduct the softness of the lower elastic layer to the upper layer or to the surface of the first and second image-bearing members and more specifically have a thickness of 1–500 μm, more preferably 5–200 μm.

The intermediate transfer member used in the present invention may preferably exhibit a surface resistance (as measured in the manner described hereinafter) in the range of $1\times10^{6}$–$1\times10^{12}$ ohm, more preferably $1\times10^{7}$–$1\times10^{11}$ ohm.

Referring again to FIG. 2, if the intermediate transfer member 20 has a surface resistance of below $1\times10^{6}$ ohm, most of a current applied to the cleaning charging member 8 is liable to pass to the intermediate transfer member 20, thus not readily charging the transfer residual toner 95 effectively. If the intermediate transfer member 20 has a surface resistance of above $1\times10^{12}$ ohm, a current does not readily pass to the intermediate transfer member 20 even when a prescribed voltage is applied to the cleaning charging member 8, thus also not readily charging effectively the transfer residual toner 95. In this case, a current passes to the intermediate transfer member if a voltage applied to the cleaning charging member 8 is increased. However, when such a high voltage is applied for charging the residual toner 95, at least a portion of the residual toner 95 is charged very strongly. As a result, the portion of the residual toner is firmly adsorped to the surface of the intermediate transfer member 20 due to image force, thus being liable to cause cleaning failure.

The surface resistance of the intermediate transfer member 20 may be measured, e.g., in the following manner.

Figure 4:
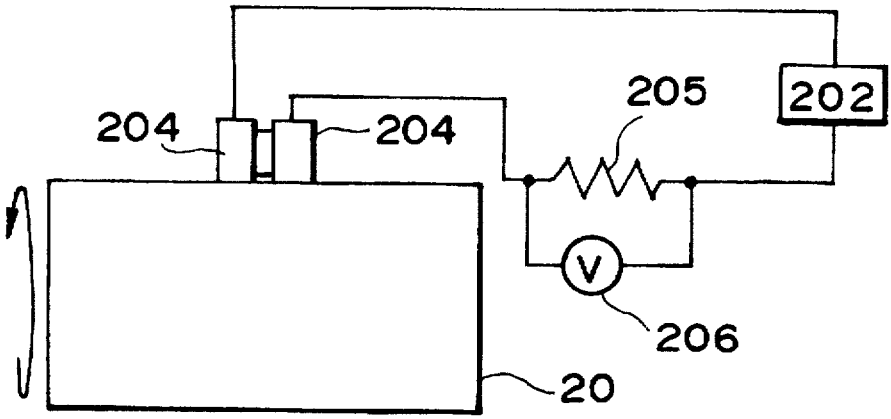
FIG. 4 is an electrical circuit diagram for measuring a surface resistance of an intermediate transfer member.

FIG. 4 shows an electric circuit diagram for measurement of the surface resistance.

Referring to FIG. 4, an intermediate transfer member 20 and a metal roller consisting of two cylindrical metals 204 connected to a DC (direct current) power supply 202, a resistor 205 and a potentiometer 206 are caused to abut against each other at a linear pressure of 40 g/cm so that their shafts are in parallel with each other. Each of the cylindrical metals 204 (diameter=40 mm, length=27 mm) constituting the metal roller is separated (insulated) from each other with a spacing of 9 mm and has a shaft aligned with each other. The metal roller is driven in rotation and controlled so as to provide the (mating) intermediate transfer member 20 with a prescribed peripheral speed (process speed) (120 mm/sec in this instance) identical to that of an intermediate transfer member when actually used in an image forming apparatus.

To the above electric circuit, a voltage of +1 (kV) is applied from the DC power supply 202, whereby a potential difference Vr (V) between both terminals of the resistor 205 providing an appropriate resistance R (ohm) is measured by the potentiometer 206 under an environmental condition of 23° C. and 40% RH.

A surface resistance (ohm) of the intermediate transfer member 20 is calculated according to the following equation:

$$\text{Surface resistance (ohm)}=1000\ (V)\times R\ (\text{ohm})/Vr\ (V)$$

The cleaning charging member 8 may assume various forms, inclusive of a metal roller, an elastic roller having electroconductivity, a fur brush having electroconductivity and an electroconductive blade, so long as the charging member can sufficiently charge the residual toner (95 in FIG. 2).

In the present invention, a current applied to the charging member 8 may preferably be 10–200 (μA), preferably 20–100 (μA).

The recovery member 9 for recovering the transfer residual toner 96 charged by the charging member 8 may assume various forms similar to those of the charging member 8 described above so long as the recovery member can recover the residual toner 96 by voltage application. A voltage applied to the recovery member 9 may preferably be 50–1500 (V), preferably 100–700 (V), as an absolute value.

In the present invention, it is possible to use the photosensitive drum 1 as the recovery member 9.

Further, it is preferred that the residual toner 96 is returned to the photosensitive drum 1 by utilizing the primary transfer bias at the time of primary-transferring a toner 94 (as shown in FIG. 2) from the photosensitive drum 1 to the intermediate transfer member 20, i.e., the primary transfer and the cleaning are performed at the same time (hereinbelow, referred to as "cleaning simultaneous with primary transfer"). In this case, the residual toner 96 is charged to have a polarity opposite to that of the toner 94 at the time of development, whereby the toner 94 on the photosensitive drum 1 is transferred onto the intermediate transfer member 20 and at the same time the residual toner 96 on the intermediate transfer member 20 is returned (transferred) to the photosensitive drum 1.

In the above step of cleaning simultaneous with primary transfer, no (electrical) discharge between the intermediate transfer member 20 and the photosensitive drum 1 is caused due to an appropriate surface potential (at most 500 (V) as an absolute value) of the intermediate transfer member 20. As a result, the residual toner 96 does not have an extraordinarily large (electric) charge. If the residual toner 96 has an extraordinarily large charge, there occurs a phenomenon such that the toner 94 is pushed (forced) back to the photosensitive drum 1 when the toner 96 and the residual toner 94 pass each other. Such a phenomenon is not desirable because a subsequent (second) printed image has a decreased image density.

For this reason, in the present invention, it is possible to perform very good cleaning simultaneous with primary transfer.

The cleaning simultaneous with primary transfer is advantageously applicable to the present invention because a time for the cleaning step is saved and the number of image sheets obtained per unit time is increased.

The first image-bearing member used in the present invention may comprise an ordinary electrophotographic photosensitive member (photosensitive drum) but preferably be a photosensitive member having a protective layer containing particles of a fluorine-containing resin, such as polytetrafluoroethylene (PTFE) on the photosensitive layer. By providing such a protective layer, the performance of primary transfer from the photosensitive member to the intermediate transfer member may be improved to provide good images free from transfer hollow dropout and a high primary transfer efficiency. On the other hand, if the intermediate transfer member does not exhibit a good secondary transfer characteristic, the transfer residual toner on the intermediate transfer member is increased, so that a substantial improvement in transfer efficiency cannot be expected but image defects, such as hollow dropout due to secondary transfer failure, are caused. The intermediate transfer member used in the present invention is free from such problems and can provide remarkable improvements in transfer efficiency and image quality in combination with a photosensitive member having such a protective layer.

The latent image-forming means, developing means, toner primary transfer means and secondary transfer means may be ordinary means, respectively, and are not particularly limitative.

The second image-bearing member used in the present invention may for example comprise paper of various types and OHP sheet.

Hereinbelow, the present invention will be described more specifically with reference to Examples and Comparative Examples, wherein "part(s)" used for describing a composition means "part(s) by weight".

EXAMPLE 1

On an aluminum drum (outer diameter (OD)=182 mm, width (W)=320 mm, thickness (T)=5 mm), a rubber compound of the following composition was transfer-molded to prepare a roller having a 5 mm-thick elastic layer.

| (Rubber compound) | |
|---|---|
| NBR (nitrile rubber) | 100 parts |
| Sulfur (vulcanizing agent) | 0.5 part |
| Zinc white (vulcanizing aid) | 2 parts |
| TBT (tetrabutylthiuram disulfide; vulcanization accelerator) | 1.5 parts |
| DM (dibenzothiazyl disulfide; vulcanization accelerator) | 1.2 parts |
| Carbon black (electroconductive material) | 27 parts |
| Stearic acid (dispersion aid) | 1.2 parts |
| Naphthene-based process oil (plasticizer) | 35 parts |

Separately, a coating (surface) layer paint of the following composition was prepared.

| (Coating layer paint) | |
|---|---|
| One component-type polyurethane | 100 parts |
| Tetrafluoroethylene resin fine powder | 200 parts |
| Electroconductive titanium oxide (needle) | 40 parts |
| DMF (dimethylformamide) | 500 parts |

The above paint was applied by spraying onto the outer surface of the roller and dried by heating at 100° C. for 2 hours to form an intermediate transfer member having a 50 μm-thick coating layer.

The thus prepared intermediate transfer member was subjected to measurement of surface potential and surface resistance according to the methods described above, respectively. The results are shown in Table 1 appearing hereinafter.

The intermediate transfer member was incorporated in a full-color electrophotographic apparatus (image forming apparatus) as shown in FIG. 1 including a photosensitive drum (1, as a first image-bearing member) having a photosensitive layer and a protective layer thereon, and subjected to full-color image formation on plain paper of 80 g/m$^2$ (as a secondary image-bearing member) to evaluate primary and secondary transfer efficiencies through measurement of respective image densities.

For the measurement, the image densities of a transfer residual image on the photosensitive member and a transferred image on the intermediate transfer member were measured for determining a primary transfer efficiency, and the image densities of a transfer residual image and a transferred image on the plain paper were measured for determining a secondary transfer efficiency, respectively by using a Macbeth reflection densitometer ("RD-918", available from Macbeth Co.). More specifically, each of the toner images was recovered by applying a cellophane adhesive tape thereon and peeling the toner image together with the adhesive tape. Then, the adhesive tape carrying the toner image and a blank adhesive tape carrying no toner (as a reference sample) were respectively applied on white paper, and the reflection densities of these samples were measured by the densitometer to determine an image density as a difference between the measured reflection densities. From the measured image densities, the respective transfer efficiencies were calculated according to the following equations.

Primary transfer efficiency (%)=[(Image density on the intermediate transfer member)/(Residual image density on the photosensitive member+Image density on the intermediate transfer member)]×100

Secondary transfer efficiency (%)=[(Image density on the plain paper)/(Residual image density on the intermediate transfer member+Image density on the plain paper)]×100

The results are shown in Table 1.

Then, a cleaning performance was evaluated by observing a state of a final solid white image according to standards shown below after performing a continuous image forming test on 5000 sheets of plain paper of 80 g/m$^2$ wherein image formation of a full-color image on 2500 sheets in total and image formation of a solid white image on 2500 sheets in total were performed alternately.

◎ (Excellent): No image defect (image failure) resulting from cleaning failure is observed.

○ (Good): A slight image defect was observed but was practically acceptable.

x (Unacceptable): Image defects were observed and were not practically acceptable.

As a result of the continuous image forming test, no image defect resulting from cleaning failure was observed. The result is also shown in Table 1.

Incidentally, in this example, the image formation was performed under the following conditions.

Photosensitive member: An electrophotographic photosensitive member having a laminar structure of an electroconductive support, an undercoating layer, a charge generation layer, a charge transportation layer and a protective layer containing tetrafluoroethylene resin powder in this order.

Dark part (non-image portion) potential: −550 volts

Light part (image portion) potential: −150 volts

Developer: non-magnetic mono-component toners of four colors (yellow, magenta, cyan and black)

Primary transfer voltage: +100 volts

Secondary transfer current: +15 μA

Process speed: 120 mm/sec

Developing bias: $V_{DC}$=−400 V, $V_{AC}$=1600 V (Vpp), frequency=1800 Hz

Cleaning charging member: Elastic roller having a resistance of 1×10$^8$ ohm and supplied with a current of 50 μA.

Toner recovery member: Electroconductive fur brush having a resistance of 1×10$^2$ ohm and supplied with a voltage of −500 volts.

Distance from cleaning charging member (charging position) to recovery position of residual toner: 5 cm (as peripheral length).

EXAMPLE 2

| (Coating layer paint) | |
|---|---|
| One component-type polyurethane | 100 parts |
| Silicone resin fine powder | 100 parts |
| Electroconductive titanium oxide (needle) | 25 parts |
| DMF | 300 parts |

The above paint was applied by spraying onto the outer surface of a roller similar to the one prepared in Example 1 and dried by heating at 100° C. for 2 hours to form an intermediate transfer member having a 30 μm-thick coating layer.

The intermediate transfer member was evaluated in the same manner as in Example 1 except that an elastic roller having a resistance of 1×10$^6$ ohm was used as a toner recovery member. The results are shown in Table 1.

EXAMPLE 3

A rubber belt (OD=150 mm, W=320 mm, T=0.8 mm) was prepared by subjecting a rubber compound of the composition indicated in Example 1 to extrusion, vapor vulcanization and polishing. On the rubber belt, a 30 μm-thick coating layer was formed in the same manner as in Example 2 to prepare an intermediate transfer member in the form of an endless belt.

The belt-shaped intermediate transfer member was subjected to measurement of surface potential and surface resistance after being worn round an aluminum cylinder (OD=148.4 mm, W=320 mm, T=2 mm). In this example, a distance from the cleaning charging member to a recovery position of a residual toner was 10 cm (as peripheral length) and the distance (10 cm) was adopted in measurement of surface potential of the intermediate transfer member.

After detaching the intermediate transfer member from the aluminum cylinder, the intermediate transfer member was incorporated in a full-color electrophotographic apparatus as shown in FIG. 5 and subjected to evaluation with respect to primary and secondary transfer efficiencies and cleaning performance in the same manner as in Example 1 except that the (toner) recovery member 9 was not used.

EXAMPLE 4

| (Coating layer paint) | |
|---|---|
| Urethane prepolymer | 100 parts |
| Isocyanate (hardener) | 10 parts |
| Tetrafluoroethylene resin fine powder | 200 parts |
| Carbon black | 100 parts |
| DMF | 500 parts |

The above paint was applied by spraying onto the outer surface of a roller similar to the one prepared in Example 1 and dried by heating at 80° C. for 2 hours to form an intermediate transfer member having a 55 μm-thick coating layer.

The intermediate transfer member was evaluated in the same manner as in Example 1. The results are shown in Table 1.

EXAMPLE 5

An intermediate transfer member was prepared and evaluated in the same manner as in Example 4 except that the addition amount (100 parts) of carbon black was changed to 10 parts.

The results are shown in Table 1.

Comparative Example 1

| (Coating layer paint) | |
|---|---|
| Fluorine-containing resin for paint | 100 parts |
| Isocyanate | 15 parts |
| Tetrafluoroethylene resin fine powder | 100 parts |
| Electroconductive titanium oxide (sphere) | 8 parts |
| Butyl acetate | 100 parts |

The above paint was applied by spraying onto the outer surface of a roller similar to the one prepared in Example 1 and dried by heating at 100° C. for 1 hours to form an intermediate transfer member having a 25 μm-thick coating layer.

The intermediate transfer member was evaluated in the same manner as in Example 1. The results are shown in Table 1.

TABLE 1

| Example No. | Surface potential* (V) | Surface resistance (ohm) | Transfer efficiency 1st | Transfer efficiency 2nd | Cleaning performance |
|---|---|---|---|---|---|
| Ex. 1 | 120 | $8 \times 10^8$ | 95 | 91 | ◎ |
| 2 | 80 | $1 \times 10^9$ | 93 | 90 | ◎ |
| 3 | 20 | $9 \times 10^8$ | 94 | 89 | ◎ |
| 4 | 70 | $8 \times 10^5$ | 95 | 81 | ○ |
| 5 | 500 | $2 \times 10^9$ | 93 | 90 | ○ |
| Comp. Ex. 1 | 550 | $3 \times 10^{11}$ | 86 | 91 | x |

*absolute value.

What is claimed is:

1. An image forming apparatus, comprising:

a first image-bearing member, latent image-forming means for forming an electrostatic latent image on the first image-bearing member, developing means for developing the electrostatic latent image with a toner to form a toner image, an intermediate transfer member, a second image-bearing member, wherein the intermediate transfer member receives the toner image by primary transfer and transfers the toner image onto the second image-bearing member by secondary transfer, a charging member for charging a residual toner remaining on the intermediate transfer member after the secondary transfer, and recovery means for recovering the charged residual toner at a recovery position, said recovery means including an electroconductive member and voltage application means for applying a voltage to the electroconductive member at the recovery position, wherein the intermediate transfer member has a charging characteristic such that it has a surface potential of at most 500 volts as an absolute value at the recovery position.

2. An apparatus according to claim 1, wherein the surface potential is at most 300 volts as an absolute value.

3. An apparatus according to claim 2, wherein the surface potential is at least 2 volts as an absolute value.

4. An apparatus according to claim 1, wherein the intermediate transfer member has a surface resistance of $1\times10^6$–$1\times10^{12}$ ohm.

5. An apparatus according to claim 4, wherein the surface resistance is $1\times10^7$–$1\times10^{11}$ ohm.

6. An apparatus according to claim 1, the residual toner is charged by the charging member under application of a current of 10–200 μA.

7. An apparatus according to claim 6, wherein the current is 20–100 μA.

8. An apparatus according to claim 1, wherein the charged residual toner is recovered by the recovery means under application of a voltage of 50–1500 volts as an absolute value.

9. An apparatus according to claim 8, wherein the applied voltage is 100–700 volts as an absolute value.

10. An apparatus according to claim 1, wherein the first image-bearing member functions as the electroconductive member and the voltage applied to the electroconductive member corresponds to a voltage for the primary transfer.

11. An apparatus according to claim 1, wherein the intermediate transfer member is in the form of a drum.

12. An apparatus according to claim 1, wherein the intermediate transfer member is in the form of an endless belt.

13. An apparatus according to claim 1, wherein the first image-bearing member is an electrophotographic photosensitive member.

* * * * *

UNITED STATES PATENT AND TRADEMARK OFFICE

CERTIFICATE OF CORRECTION

PATENT NO. : 5,752,130

DATED : May 12, 1998

INVENTOR(S) : Atsushi TANAKA, et al.

It is certified that error appears in the above-identified patent and that said Letters Patent is hereby corrected as shown below:

COLUMN 1:

Line 11, "once" should read --first--.

COLUMN 3:

Line 53, "image" should read --an image--.

COLUMN 4:

Line 28, "similar manners" should read --a similar manner--.

COLUMN 6:

Line 67, "theroplastic" should read --thermoplastic--.

COLUMN 7:

Line 45, "containing" should read --contain--.

UNITED STATES PATENT AND TRADEMARK OFFICE

CERTIFICATE OF CORRECTION

PATENT NO. : 5,752,130

DATED : May 12, 1998

INVENTOR(S) : Atsushi TANAKA, et al.

It is certified that error appears in the above-identified patent and that said Letters Patent is hereby corrected as shown below:

COLUMN 12:

Line 65, "hours" should read --hour--.

COLUMN 14:

Line 14, "the" should read --wherein the--.

Signed and Sealed this

Fifteenth Day of June, 1999

*Attest:*

*Attesting Officer*

Q. TODD DICKINSON

*Acting Commissioner of Patents and Trademarks*